US006796860B1

(12) United States Patent
Takahashi

(10) Patent No.: US 6,796,860 B1
(45) Date of Patent: Sep. 28, 2004

(54) LUBRICANT PUMP SEAL FOR OUTBOARD MOTOR

(75) Inventor: Masanori Takahashi, Shizuoka (JP)

(73) Assignee: Yamaha Marine Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 10/227,506

(22) Filed: Aug. 22, 2002

(30) Foreign Application Priority Data

Aug. 22, 2001 (JP) ..... 2001-251912

(51) Int. Cl.[7] ..... B63H 21/10

(52) U.S. Cl. ..... 440/88 L; 123/196 W; 184/6.18

(58) Field of Search ..... 440/88 R, 88 L; 123/196 W, 196 CP, 196 R; 184/6.18, 6.28, 26, 27.1

(56) References Cited

U.S. PATENT DOCUMENTS

| | | | | |
|---|---|---|---|---|
| 5,094,639 A | | 3/1992 | Onoue | |
| 5,215,164 A | * | 6/1993 | Shibata | 184/6.13 |
| 5,687,686 A | * | 11/1997 | Takahashi | 123/195 P |
| 5,701,872 A | | 12/1997 | Kaku et al. | |
| 5,769,036 A | * | 6/1998 | Takahashi et al. | 123/41.33 |
| 5,876,188 A | | 3/1999 | Okamoto | |
| 5,980,340 A | | 11/1999 | Okamoto | |
| 6,041,892 A | | 3/2000 | Watanabe et al. | |
| 6,099,374 A | | 8/2000 | Watanabe et al. | |
| 6,192,853 B1 | * | 2/2001 | Natsume | 123/196 W |
| 6,286,476 B1 | | 9/2001 | Hiraoka et al. | |
| 6,401,682 B1 | * | 6/2002 | Nozue | 123/196 W |
| 6,626,714 B2 | * | 9/2003 | Nozue | 440/88 L |
| 6,648,705 B2 | * | 11/2003 | Nakata et al. | 440/83 |

OTHER PUBLICATIONS

Publication No. US 2002/0115361 A1, entitled Oil Pump arrangement for Marine Drive, inventor Toshihiro Nozue, published on Aug. 22, 2002.

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A lubricant pump seal for an outboard motor is provided. The lubricant pump seal comprises a first sealing body in an upper clearance formed between an upper through hole of a lubricant pump casing and a driveshaft extending through the upper through hole, a second sealing body in a lower clearance formed between a lower through hole of the lubricant pump casing and the driveshaft extending through the lower through hole, a third sealing body in the lower clearance below the second sealing body, and a fourth sealing body in the lower clearance between the second and third sealing bodies. Preferably, the lubricant pump seal further comprises a fluid communication passage between a space in the lower clearance and a lubricant reservoir or interior space of a cowling. When negative pressure is generated in the space during operation of the lubricant pump, fluid flows through the passage and into the space, thereby eliminating the negative pressure and preventing moisture from penetrating the space.

17 Claims, 7 Drawing Sheets

LUBRICANT PUMP SEAL FOR OUTBOARD MOTOR

PRIORITY INFORMATION

This application claims priority to Japanese Patent Application No. 2001-251912, filed on Aug. 22, 2001, the entire contents of which are hereby expressly incorporated by reference.

BACKGROUND OF THE INVENTION

1. Field of the Invention

The present invention relates to outboard motors for watercraft, and in particular, a lubricant pump seal for outboard motors.

2. Description of the Related Art

Outboard motors containing internal combustion engines are commonly used for powering watercraft. A housing, which is mounted to a transom of the watercraft, typically encloses the engine. Rotation of an output shaft of the internal combustion engine drives a driveshaft. The driveshaft drives a water propulsion device, such as a propeller. When the watercraft operates, the propeller is submerged beneath a water surface. Rotation of the propeller moves the watercraft across the water surface.

Internal combustion engines require lubricant for normal operation. Four-cycle engine typically employ a recirculating type of lubrication system. In such a system, a lubricant pump supplies lubricant to a crank chamber and other moving components of the engine. The lubricant pump also circulates lubricant between the crank chamber and a lubricant pan. The lubricant pump is usually located near the coupling of the output shaft and the driveshaft, so that the rotation of the output shaft can be used to drive the lubricant pump.

The lubricant pump typically comprises a pump casing defining a pump chamber. The drive shaft penetrates the pump chamber. A first sealing body seals an upper clearance formed between an upper part of the pump casing and the drive shaft. Second and third sealing bodies seal a lower clearance formed between a lower part of the pump casing and the drive shaft.

The outboard motor interfaces with the body of water upon which the watercraft moves. Lubricant exiting the motor pollutes the body of water. Ideally the outboard motor operates as cleanly as possible in order to protect our limited natural resources. The first and second sealing bodies typically prevent lubricant from exiting the pump casing.

Often, the motor draws in water from the surrounding body of water for cooling the engine and an exhaust system. However, water penetrating the coupling of the output shaft and driveshaft adversely affects the performance and longevity of the engine. Impurities in the water, especially salt, deposit on the shafts and cause corrosion. The corrosion causes the shafts to stick together. The third sealing body is designed to prevent water from entering the pump casing.

However, during operation, the lubricant pump creates negative pressure in the region of the coupling. This negative pressure draws in ambient air and water. The water and moisture contained in the air causes corrosion. Prior attempts at preventing moisture penetration due to negative pressure in the pump chamber have been unsuccessful.

SUMMARY OF THE INVENTION

The preferred embodiments of the present lubricant pump seal for an outboard motor have several features, no single one of which is solely responsible for their desirable attributes. Without limiting the scope of this lubricant pump seal for outboard motor as expressed by the claims that follow, certain features are described below. After considering this discussion, and particularly after reading the section entitled "Detailed Description of the Preferred Embodiments," one will understand how the features of the preferred embodiments provide advantages, which include reliable prevention of water penetration into an interior of the lubricant pump.

One aspect of the present invention includes the realization that negative pressure developed by lubricant pump can be relieved, thereby preventing the lubricant pump from drawing humid air or water into the lubricant pump. One preferable way of relieving the pressure is to provide a passage extending from the lubricant pump to a source of dry air. By constructing in the lubricant pump as such, water infiltration into the lubricant pump can be prevented.

In accordance with one preferred embodiment of the present invention, a lubricant pump seal is provided for an outboard motor. The outboard motor comprises a an internal combustion engine, a water propulsion device, a drive shaft configured to transmit torque from the engine to the water propulsion device, and a lubricant pump configured to supply lubricant to the internal combustion engine. The lubricant pump includes a pump casing enclosing a pump chamber. The drive shaft extends through the pump casing. A rotor is housed in the pump chamber for rotation with the drive shaft. A first sealing body for sealing an upper clearance is formed between an upper part of the pump casing and the drive shaft. Second and third sealing bodies for sealing a lower clearance are formed between a lower part of the pump casing and the drive shaft. A fourth sealing body is disposed between the second and third sealing bodies in an axial direction of the drive shaft. The fourth sealing body seals the lower clearance.

The lubricant pump seal preferably further comprises a fluid communication passage between a space in the lower clearance sandwiched between the second and third sealing bodies and a lubricating oil reservoir inside the internal combustion engine. At least a portion of the passage may comprise a groove in an auxiliary pump casing. Alternatively, at least a portion of the passage may comprise a groove in a lower surface of a casing body.

The lubricating oil reservoir may comprise a crank chamber of the engine. Alternatively, the lubricating oil reservoir may comprise a lubricant pan located below a crank chamber of the engine.

The lubricant pump seal preferably further comprises a fluid communication passage between a space in the lower clearance sandwiched between the second and third sealing bodies and an inside space of the cowling. At least a portion of the passage may comprise a groove in an auxiliary pump casing. Alternatively, at least a portion of the passage may comprise a groove in a lower surface of a casing body.

Another aspect of the present invention includes a method of preventing moisture penetration into an interior of a lubricant pump of an outboard motor. The method comprises providing a fluid communication passage between the interior of the lubricant pump and a lubricant reservoir, generating negative pressure within the interior of the lubricant pump, and channeling fluid from the lubricant reservoir to the interior of the lubricant pump, thereby eliminating the negative pressure.

Yet another aspect of the present invention is directed to a method of preventing moisture penetration into an interior of a lubricant pump of an outboard motor. The method comprises the steps of providing a fluid communication passage between the interior of the lubricant pump and a space inside a cowling, generating negative pressure within the interior of the lubricant pump, and channeling fluid from the space inside the cowling to the interior of the lubricant pump, thereby eliminating the negative pressure.

In accordance with a further aspect of the present invention, an outboard motor comprises an internal combustion engine, a propulsion unit driven by the engine, and a housing enclosing the engine and at least a portion of the propulsion unit. A drive shaft extends between the engine and the propulsion unit. A lubricant pump unit is configured to deliver lubricant to the engine. The drive shaft extends through the lubricant pump unit. A seal is disposed between the lubricant pump unit and the drive shaft. Additionally, the outboard motor includes means for relieving a negative pressure generated in the vicinity of the seal.

In accordance with yet another aspect of the present invention, an outboard motor comprises an internal combustion engine, a propulsion unit driven by the engine, and a housing enclosing the engine and at least a portion of the propulsion unit. A drive shaft extends between the engine and the propulsion unit. A lubricant pump unit is configured to deliver lubricant to the engine. The drive shaft extends through the lubricant pump unit. A clearance is defined between the drive shaft and the lubricant pump unit. At least one seal is in contact with the drive shaft and is configured to seal the interior of the lubricant pump unit from an exterior of the pump unit. A passage extends from the clearance to exterior of the lubricant pump unit.

BRIEF DESCRIPTION OF THE DRAWINGS

The preferred embodiments of the lubricant pump seal for outboard motor, illustrating its features, will now be discussed in detail. These embodiments depict the novel and non-obvious lubricant pump seal for outboard motor shown in the accompanying drawings, which are for illustrative purposes only. These drawings include the following figures, in which like numerals indicate like parts.

DETAILED DESCRIPTION OF THE PREFERRED EMBODIMENTS

Figure 1:
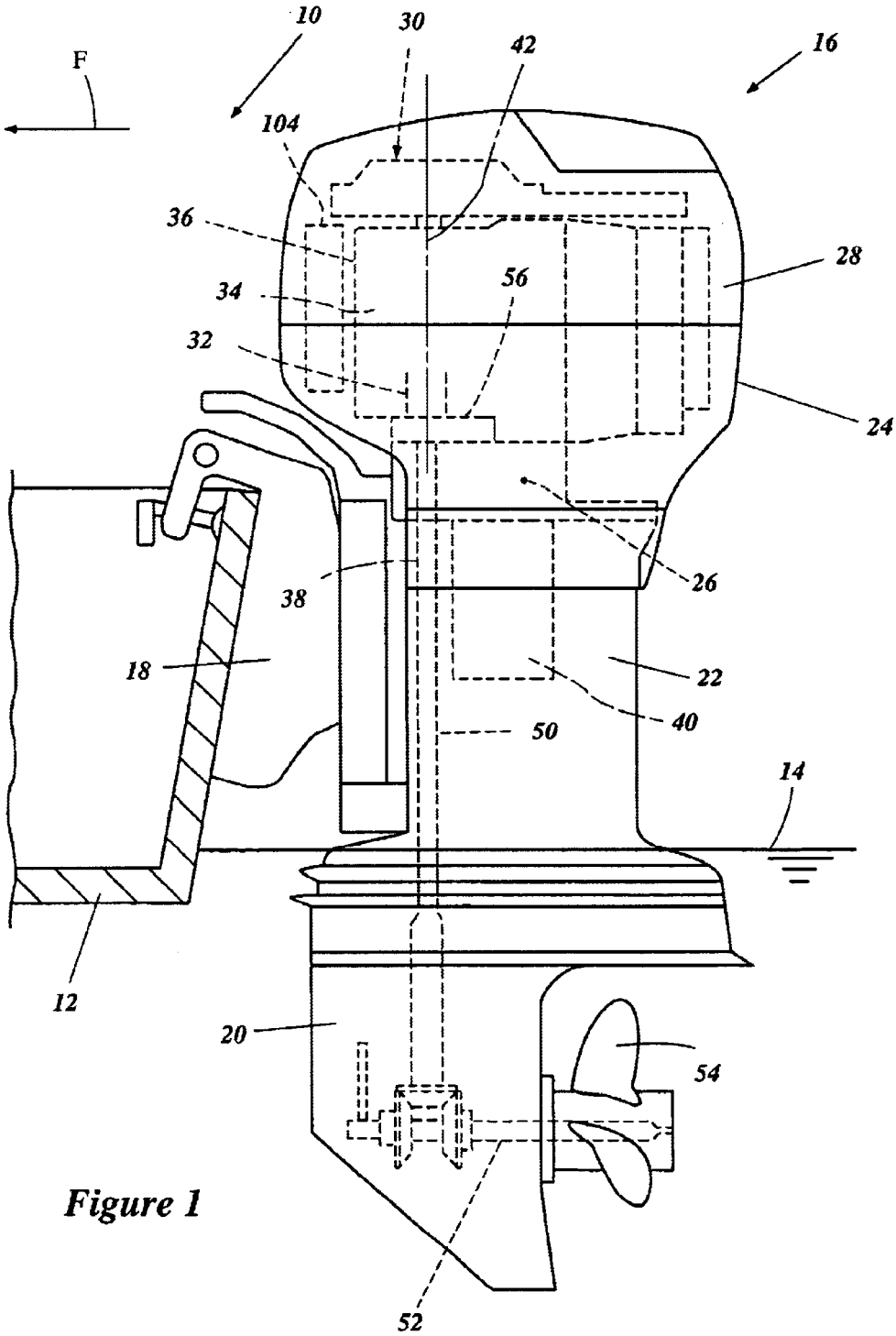
FIG. 1 is a side elevational view of an outboard motor constructed in accordance with the present invention, with certain features including an engine, driveshaft, and transmission shown in phantom.

With reference to FIG. 1, an overall configuration of an outboard motor is described below to assist the reader's understanding of a preferred environment of use. However, it is apparent to one of ordinary skill in the art that the lubricant pump and associated components described below can be used in other vehicles, such as, for example, but without limitation, personal watercraft, jet boats, off-road vehicles, and other vehicles. Additionally, The outboard motor is described in reference to a coordinate system wherein a longitudinal axis extends from fore to aft and a lateral axis from port side to starboard side normal to the longitudinal axis. In addition, relative heights are expressed as elevations in reference to the under surface of the watercraft 30. In various figures, an arrow denoted with the legend "forward" is used to denote the direction in which the watercraft travels during normal forward operation FIG. 1 illustrates a watercraft 10 comprising a hull 12 floating on a water surface 14. The arrow F indicates a forward direction of travel of the watercraft 10. The watercraft 10 includes an outboard motor 16. A clamping bracket 18 secures the outboard motor 16 to the hull 12.

A casing houses the components of the outboard motor 16. The casing includes a lower portion 20, which is submerged beneath the water surface 14, an intermediate portion 22 extending generally vertically from the lower portion 20, and an upper portion 24 extending generally vertically from the intermediate portion 22. An exhaust guide 26 extends through portions of the intermediate portion 22 and upper portion 24. The exhaust guide 26 can be configured to selectively open and close an opening at an upper end of the intermediate portion 22.

The upper portion 24 comprises a cowling 28, which is generally constructed of a sturdy plastic. The cowling 28 contains an internal combustion engine 30, which generates power to propel the watercraft 10 across the water surface 14. The engine 30 includes a plurality of pistons (not shown) that reciprocate within their respective cylinders (not shown) in response to combustion reactions in each cylinder. Each piston is connected, via a piston rod, to a crankshaft 32, which is housed in a crank chamber 34 of a crankcase 36. The reciprocating motion of the pistons turns the crankshaft 32, which turns a vertically extending driveshaft 38. A lower portion of the crankcase 36 comprises a lubricant reservoir 40. Lubricant from the lubricant reservoir 40 is supplied to the moving parts in the crank chamber 34, an other components of the engine 30, described in greater detail below.

The driveshaft 38, having an axis of rotation 42, extends from the upper portion 24, through the intermediate portion 22 and into the lower portion 20. An upper portion of the driveshaft 38 is rotatably connected to the crankshaft 32. In the illustrated embodiment, an outer surface of the upper end of the driveshaft 38 includes splines 46 (FIG. 2) which engage splines formed on an inner diameter of the crankshaft 32.

Figure 2:
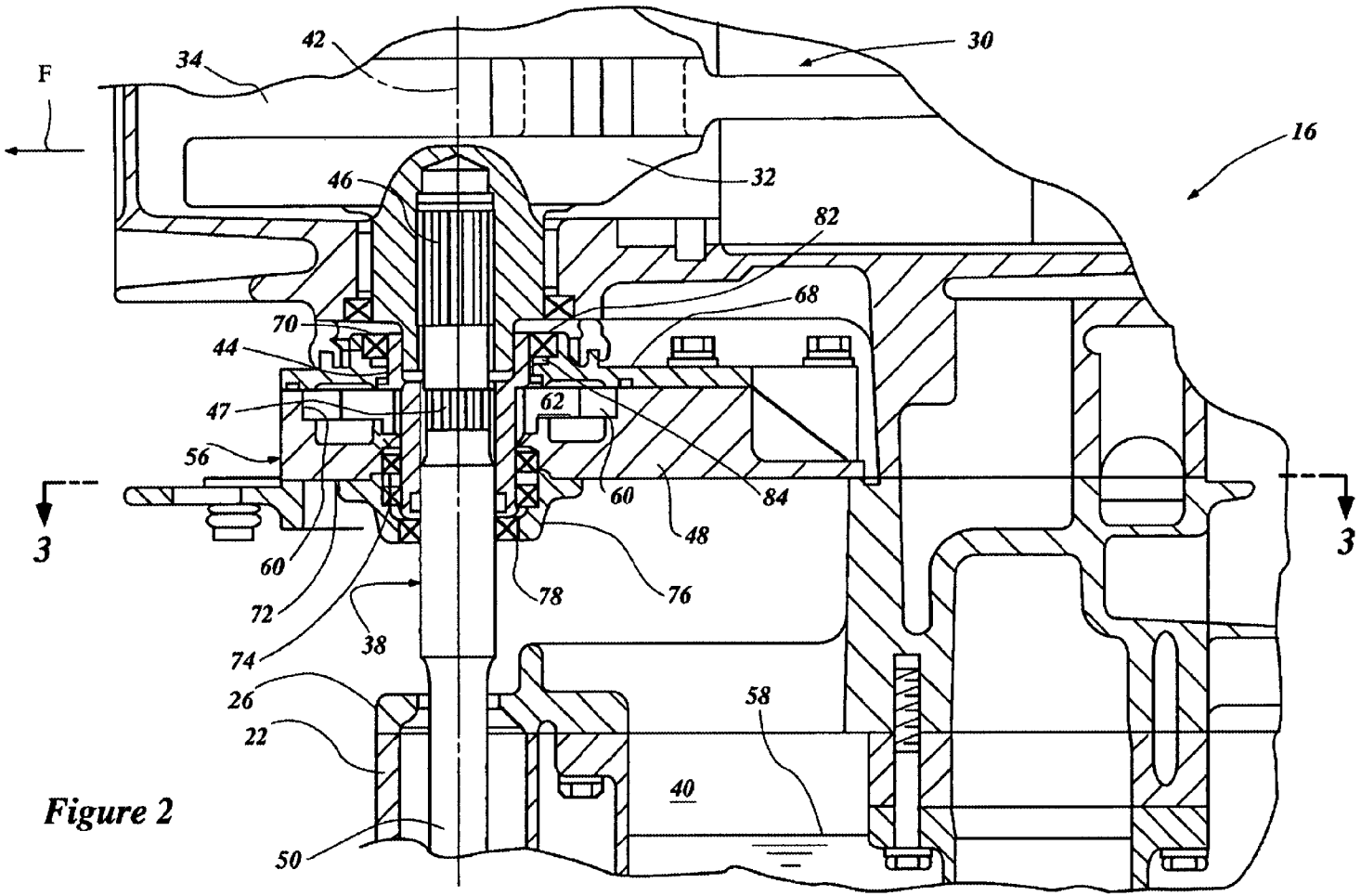
FIG. 2 is an enlarged partial sectional view of the outboard motor of FIG. 1 illustrating a lubricant pump therein, taken along a vertical plane passing through a rotational axis of the drive shaft and extending generally fore to aft.

With reference to FIG. 2, a cylindrical body 44 is rotatably connected to the driveshaft 38 for rotation with one another. In the illustrated embodiment, an outer surface of the drive shaft 38 includes another set of splines 47 arranged below the splines 46. The splines 47 engage splines disposed on an inner surface of the cylindrical body 44. The cylindrical body 44 extends downward along the axis of rotation 42 toward a lower end of a pump casing 48, which is described in detail below.

The driveshaft body 50 extends downward from the cylindrical body 44 along the axis of rotation 42. A lower end of the driveshaft body 50 is operably connected to a propeller shaft 52 (FIG. 1). The propeller shaft 52 extends generally parallel to the water surface 14, and includes a propeller 54 mounted to a rear end thereof. The propeller 54 rotates with the propeller shaft 52, generating force on the water. The reaction force of the water upon the propeller 54 propels the watercraft 10 across the water surface 14.

Figure 3:
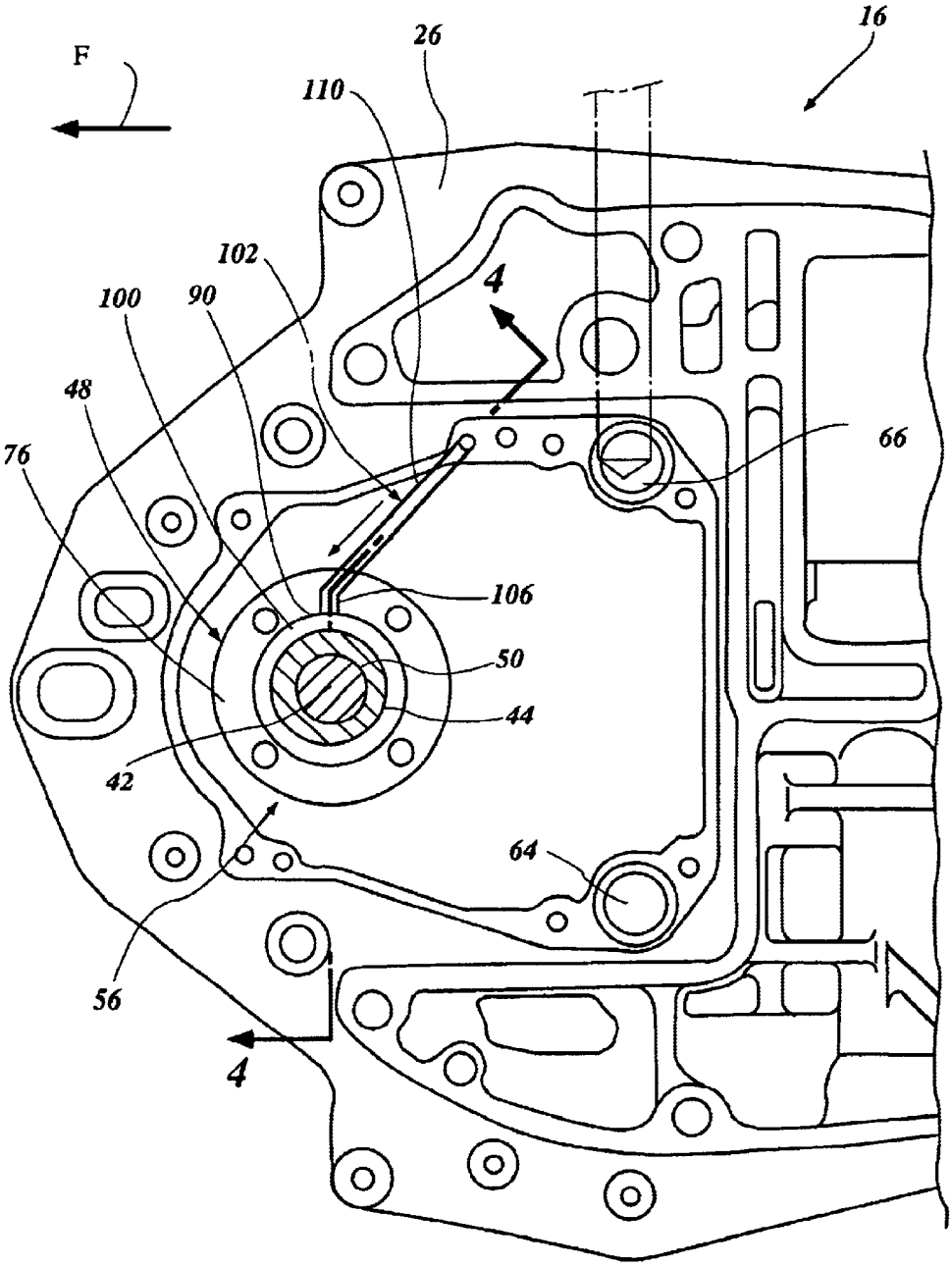
FIG. 3 is a partial cross-sectional view of the outboard motor of FIG. 1, taken along line 3—3 in FIG. 2.
Figure 4:
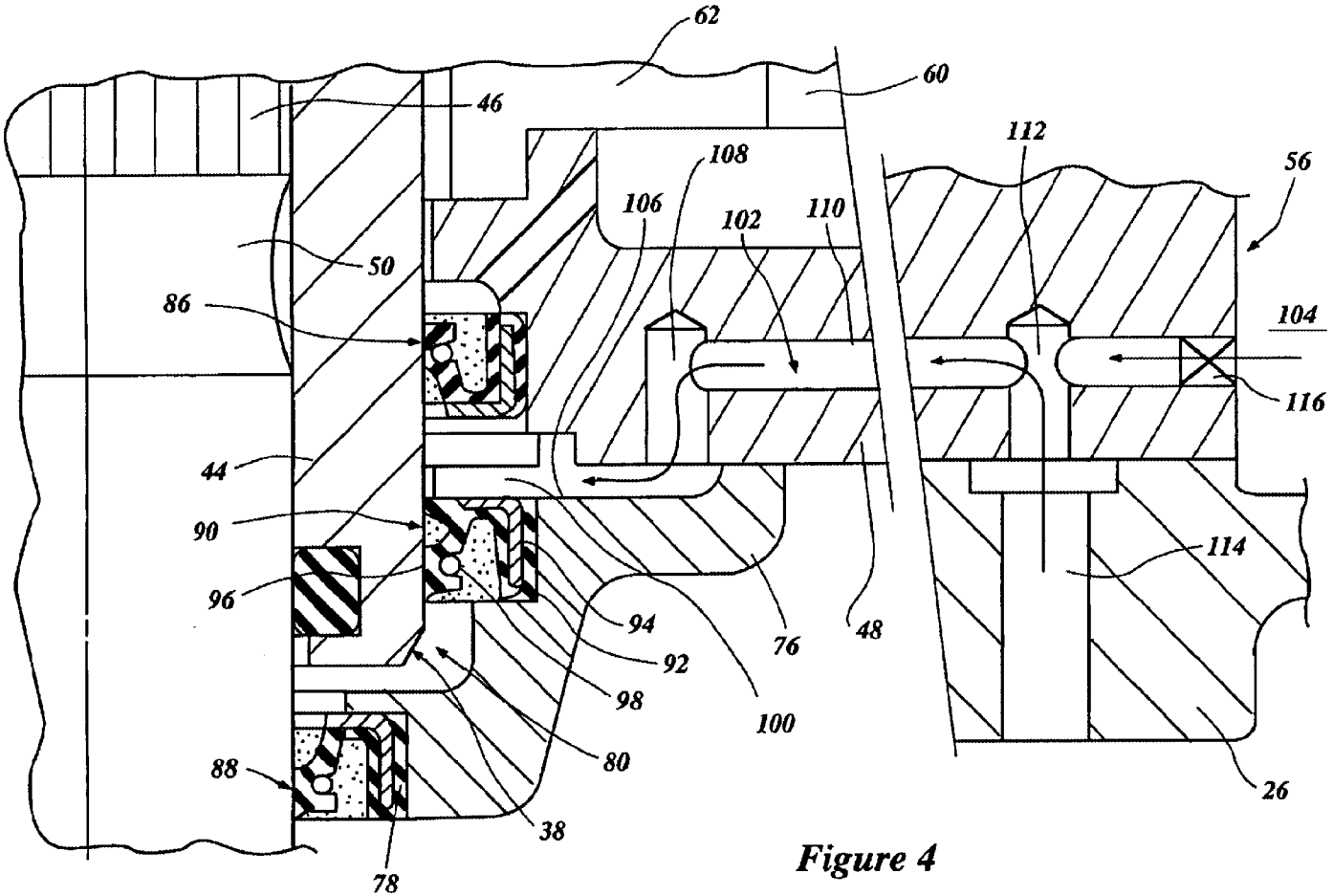
FIG. 4 is a partial cross-sectional view of the outboard motor of FIG. 1, taken along line 4—4 in FIG. 3 and illustrating the lubricant pump and a lubricant pump seal.

The outboard motor 16 includes a trochoid-type lubricant pump 56, which is illustrated in detail in FIGS. 2–4. The lubricant pump 56 circulates lubricant 58 (FIG. 3) from the lubricant reservoir 40 to portions of the engine 30 that benefit from lubrication, such as, for example, but without limitation, crankshaft bearings cylinder walls, piston pins, and valvetrain components. The pump casing 48, which is located on top of the exhaust guide 26, encloses the lubricant pump 56 (FIGS. 2 and 3). An interior portion of the pump casing 48 comprises a pump chamber 60. A portion of the cylindrical body 44 within the pump chamber 60 includes a rotor 62 (FIG. 3). The rotor 62 rotates with the cylindrical body 44 about the axis of rotation 42.

As illustrated in FIG. 3, the pump casing 48 includes a lubricant intake port 64. The lubricant pump 56 draws lubricating oil 58 from the lubricant reservoir 40 through the lubricant intake port 64 and into the pump chamber 60. The lubricant pump 56 expels the oil 58 through a lubricant delivery port 66 to portions of the engine 30 that require lubrication. The lubricating oil 58 flows downward under the influence of gravity and returns to the lubricant reservoir 40 (FIG. 3).

An upper wall 68 of the pump casing 48 includes a through-hole 70 (FIG. 2) that is centered on the axis of rotation 42. Similarly, a lower wall 72 of the pump casing 48 includes a through-hole 74 (FIG. 2) that is centered on the axis of rotation 42. A lower pump casing 76 is secured to a lower surface of the pump casing 48 around the lower through-hole 74. The lower pump casing 76 is annular, including a through-hole 78 (FIGS. 2 and 4) that is centered about the axis of rotation 42. Preferably the lower pump casing 76 is secured to the pump casing 48 with fastening members (not shown). A gasket (not shown) disposed between the pump casing 48 and the lower pump casing 76 seals the junction between the pump casing 48 and the lower pump casing 76.

The driveshaft body 50 extends through both the upper and lower through-holes 70, 74 and through the through-hole 78 in the lower pump casing 76 (FIG. 2). The cylindrical body 44 extends through the upper and lower through-holes 70, 74. A lower end of the cylindrical body 44 is located within an annular lower clearance 80, or interior region between the pump casing 48 and the auxiliary pump casing 76 (FIG. 4). A first sealing body 82 seals an annular upper clearance 84 (FIG. 2) between an inner circumferential surface of the upper through-hole 70 and an outer circumferential surface of the cylindrical body 44.

Second and third sealing bodies 86, 88 seal the annular lower clearance 80 (FIG. 4). The second sealing body 86 is located between an inner circumferential surface of the lower through-hole 74 and an outer circumferential surface of the cylindrical body 44. The third sealing body 88 is located between an inner circumferential surface of the through-hole 78 in the lower pump casing 76 and an outer circumferential surface of the driveshaft body 50. A fourth sealing body 90 is located between the second and third sealing bodies 86, 88 preferably on an annular shoulder 92 defined by the lower pump casing 76. The fourth sealing body 90 assists the second and third sealing bodies 86, 88 to seal the lower clearance 80.

With reference to FIG. 4, each sealing body 82, 86, 88, 90 comprises a metal annular frame 94 (FIG. 1) press-fit in the inside circumferential surface of its respective through hole 70, 74, 78 and shoulder 92. An elastic rubber sealing lip 96 is secured to the annular frame 94, for example, by vulcanization. The lip 96 protrudes from the annular frame 94 toward the driveshaft 38, and abuts in sliding contact the outside circumferential surface of the driveshaft 38. An annular spring 98 fitted on the sealing lip 96 to bias the sealing lip 96 toward the outside circumferential surface of the driveshaft 38, thus increasing a strength of contact between the sealing lip 96 and the driveshaft 38 or cylindrical member 44.

The sealing lips 96 of the first and second sealing bodies 82, 86 protrude obliquely upwardly from the annular frames 94. The second sealing body 86 effectively prevents the lubricating oil 58 in the pump chamber 60 from leaking to the outside below the pump casing 48 through the lower clearance 80.

The sealing lips 96 of the third and fourth sealing bodies 88, 90 protrude obliquely downwardly from the annular frames 94 (FIG. 1). The third and fourth sealing bodies 88, 90 reliably prevent water below the pump casing 48 from entering the pump chamber 60 through the lower clearance 80.

While operating, the lubricant pump 56 generates negative pressure in a space 100 (FIG. 4) in the lower clearance 80 between the second and third sealing bodies 86, 88. This negative pressure tends to draw in air and moisture through the through-hole 78 in the auxiliary pump casing 76, leading to the problems described above. To relieve the negative pressure and thus prevent the negative pressure from drawing in air and moisture through the through-hole 78 in the lower pump casing 76, the pump casing 48 includes a passage 102 extending between the space 100 and the lubricant reservoir 40. Thus, the negative pressure in the space 100 generated by the lubricant pump 56 draws air from the lubricant reservoir 40, through the passage 102 and into the space 100. Since the air in the lubricant reservoir 40 is relatively dry, very little moisture travels to the space 100 through the passage 102. Attentively, the passage 102 can connect the space 100 with an interior space 104 of the cowling 28, which also contains dry air.

A first portion of the passage 102 comprises a radial groove 106 (FIGS. 3 and 4) formed in an upper surface of the lower pump casing 76. A second portion of the passage 102 comprises a first vertical bore 108 in the lower surface 72 of the pump casing 48. A lower opening of the first vertical bore 108 adjoins the groove 106. A third portion of the passage 102 comprises a horizontal bore 110 in the pump casing 48 that extends from an upper end of the first vertical bore 108, through a wall of the pump casing 48 to an interior space 104 of the cowling 28. A fourth portion of the passage 102 comprises a second vertical bore 112 in the lower surface 72 of the pump casing 48. The second vertical bore 112 extends upward from the lower surface 72 to the horizontal bore 110.

With reference to FIG. 4, the passage 102 extends from the space 100, through the groove 106 in the auxiliary pump casing 76, into a lower end of the first vertical bore 108, from an upper end of the first vertical bore 108 through the horizontal bore 110, into an upper end of the second vertical bore 112 and downward through a lower end of the second vertical bore 112. The lower end of the second vertical bore 112 adjoins a vertical bore 114 in the exhaust guide 26, which is in fluid communication with the lubricant reservoir 40. Thus, the space 100 is in fluid communication with the lubricant reservoir 40 through the passage 102.

When the lubricant pump 56 generates negative pressure in the space 100, air is drawn out of the lubricant reservoir 40, through the vertical bore 114 in the exhaust guide 26, through the passage 102 and into the space 100 (in the direction of the solid-line arrows in FIG. 1). Since the air in the lubricant reservoir 40 is dry, the fluid path from the lubricant reservoir 40 to the space 100 created by the passage 102 reliably prevents moisture from penetrating the space 100. Additionally, the air in the lubricant reservoir, above the level of liquid lubricant, can include oil vapors entrained therein, which can help displace water vapors. Without the fluid path, air and moisture would tend to be drawn in from the ambient through the third and fourth seals 88, 90.

A seal 116 can be mounted at the at the end of the horizontal bore 110 adjacent the wall of the pump casing 48 to ensure that the space 100 is in fluid communication with the lubricant reservoir 40 only. If desired, the seal 116 may be removed such that the space 100 is in fluid communication with both the lubricant reservoir 40 and the interior space 104 of the cowling 28. Alternatively, the seal 116 and the second vertical bore 112 need not be provided, such that the space 100 is in fluid communication with the interior space 104 of the cowling 28 only.

Advantageously, the groove 106 is relatively easy and inexpensive to manufacture. Thus, the groove 106 lessens the complexity and cost of manufacturing the lubricant pump 56 while still reliably preventing moisture from penetrating the interior of the lubricant pump 56. Those of skill in the art will appreciate that the groove 106 could be formed in the lower surface 72 of the pump casing 48, rather than in the lower pump casing 76.

Figure 5:
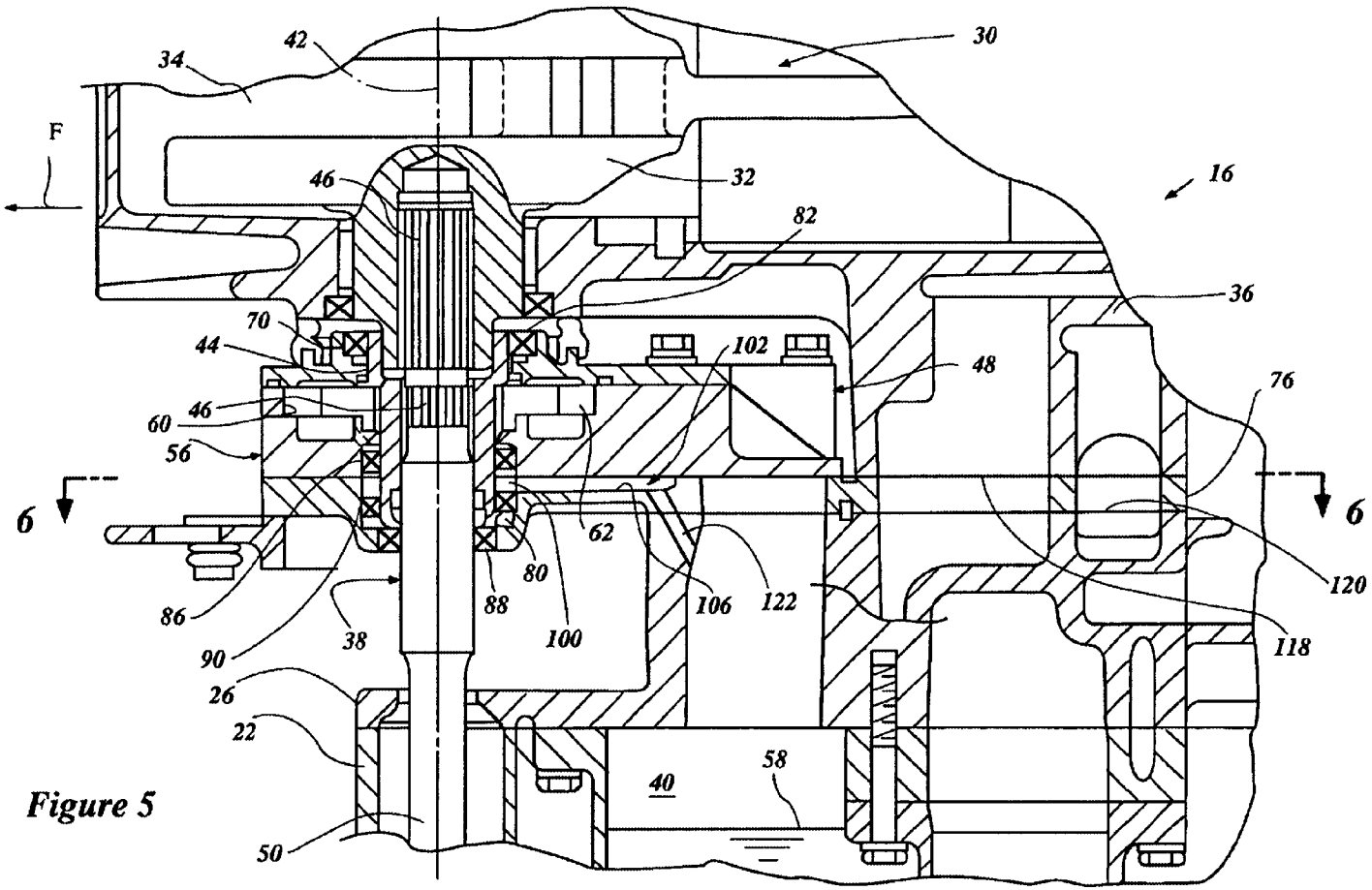
FIG. 5 is a partial cross-sectional view of a modification of the outboard motor of FIG. 1 illustrating a lubricant pump therein, taken along a vertical plane passing through a rotational axis of the drive shaft and extending generally fore to aft.
Figure 6:
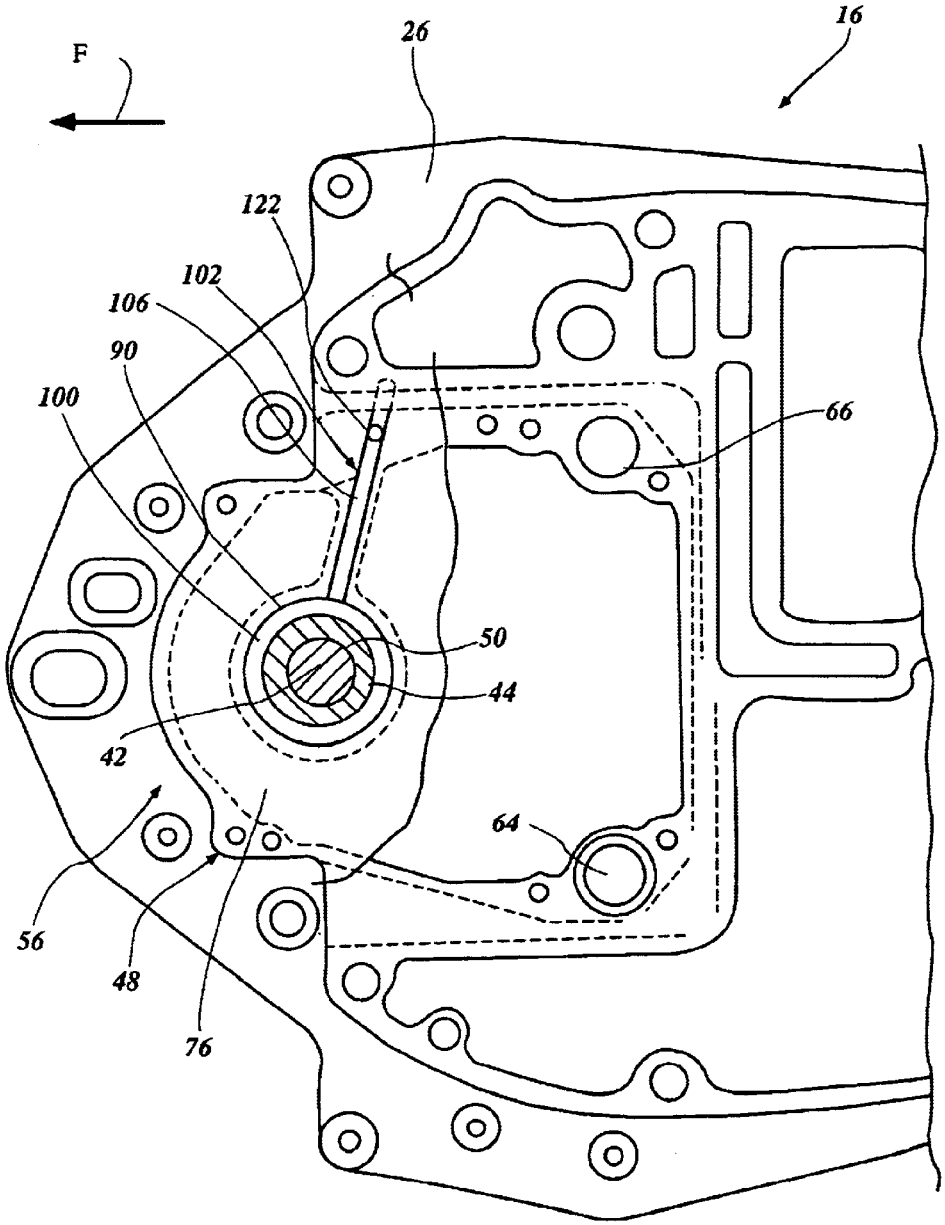
FIG. 6 is a cross-sectional view of the outboard motor of FIG. 5, taken along line 6—6 in FIG. 5.

FIGS. 5 and 6 illustrate a modification of the present lubricant pump seal arrangement described above with reference to FIGS. 1–4. The pump seal arrangement illustrated in FIGS. 5 and 6, and described below, is substantially identical to the embodiment described above, except as noted below.

In the modification of FIGS. 5 and 6, the lower pump casing 76 is shaped substantially as a plate, and is sandwiched between a lower surface 118 of the crankcase 36 and the upper surface 120 of the exhaust guide 26 (FIG. 5). The crankcase 36, lower pump casing 76 and exhaust guide 26 are all fixed together.

An upper surface of the lower pump casing 76 includes a groove 106 comprising a portion of a passage 102 (FIGS. 5 and 6). The passage 102 extends from the space 100 in the lower clearance 80, through the groove 106, and into a diagonally oriented bore 122 (FIG. 5). The diagonally oriented bore 122 extends through the lower pump casing 76 and the exhaust guide 26. A lower end of the diagonal bore 122 is in fluid communication with the lubricant reservoir 40.

The passage 102 thus extends from the space 100 in the lower clearance 80, through the groove 106, and through the diagonal bore 122 in the auxiliary pump casing 76 and exhaust guide 26 into the lubricant reservoir 40. Just as with the previous embodiment, negative pressure in the space 100 draws dry air out of the lubricant reservoir 40, through the passage 102 and into the space 100.

Figure 7:
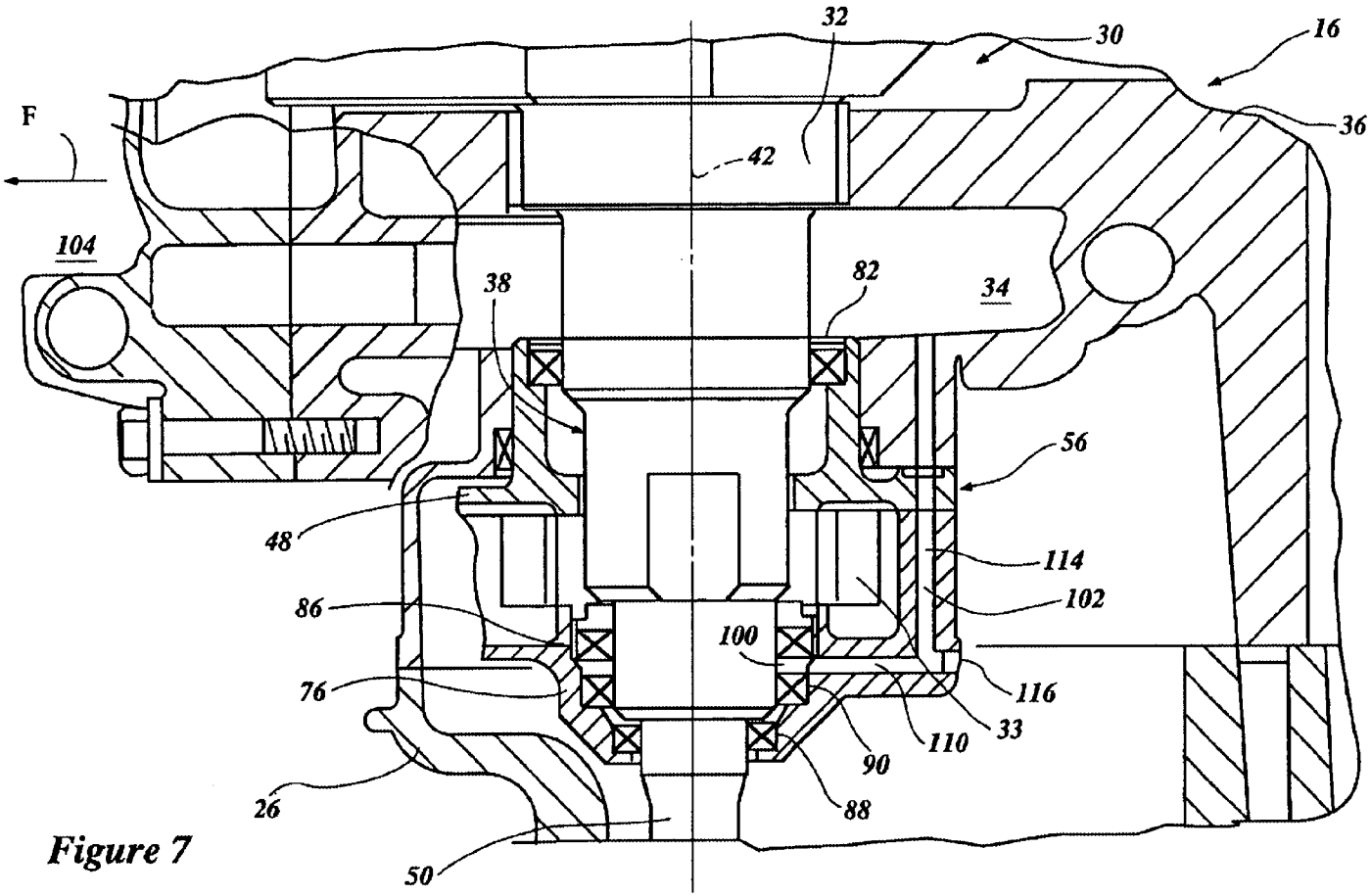
FIG. 7 is an enlarged partial cross-sectional view of a further modification of the outboard motor shown in FIGS. 1–6, taken along a vertical plane passing through a rotational axis of the driveshaft and extending generally fore to aft.

FIG. 7 illustrates another modification of the lubricant pump seal arrangement of FIGS. 1–4. In this modification, the pump casing 48 is fixed to the bottom of the crankcase 36. The lower pump casing 76 includes a horizontal bore 110 through a side wall that extends to the space 100. Preferably a seal 116 closes the bole in the side wall. A vertical bore 114 extends downward from a lower wall of the crank chamber 34 through the crankcase 36, through the pump casing 48, through the lower pump casing 76 and intersects the horizontal bore 110. The bores thus create a passage 102 that brings the space 100 into fluid communication with the crank chamber 34 in which lubricant collects before returning to the lubricant reservoir 40. Negative pressure generated in the space 100 draws lubricant or air out of the crank chamber 34, through the passage 102 and into the space 100.

Scope of the Invention

The above presents a description of the best mode contemplated for carrying out the present lubricant pump seal for outboard motor, and of the manner and process of making and using it, in such full, clear, concise, and exact terms as to enable any person skilled in the art to which it pertains to make and use this lubricant pump seal for outboard motor. This lubricant pump seal for outboard motor is, however, susceptible to modifications and alternate constructions from that discussed above that are fully equivalent. Consequently, this lubricant pump seal for outboard motor is not limited to the particular embodiments disclosed. On the contrary, this lubricant pump seal for outboard motor covers all modifications and alternate constructions coming within the spirit and scope of the lubricant pump seal for outboard motor as generally expressed by the following claims, which particularly point out and distinctly claim the subject matter of the lubricant pump seal for outboard motor.

What is claimed is:

1. A lubricant pump seal for an outboard motor, the outboard motor comprising an internal combustion engine, a water propulsion device, a drive shaft configured to transmit torque from the engine to the water propulsion device, a lubricant pump configured to supply lubricant to the internal combustion engine, the lubricant pump including a pump casing enclosing a pump chamber, the drive shaft extending through the pump casing, a rotor housed in the pump chamber for rotation with the drive shaft, a first sealing body for sealing an upper clearance formed between an upper part of the pump casing and the drive shaft, a first passage configured to guide liquid lubricant to the pump chamber and a second passage configured to guide air to an outlet of the second passage, the outlet being disposed at a point outside the pump chamber and within the pump casing where negative pressure is generated during operation of the pump, the first sealing body being disposed between the pump chamber and the point.

2. A lubricant pump seal for an outboard motor, the outboard motor comprising an internal combustion engine, a water propulsion device, a drive shaft configured to transmit torque from the engine to the water propulsion device, a lubricant pump configured to supply lubricant to the internal combustion engine, the lubricant pump including a pump casing enclosing a pump chamber, the drive shaft extending through the pump casing, a rotor housed in the pump chamber for rotation with the drive shaft, a first sealing body for sealing an upper clearance formed between an upper part of the pump casing and the drive shaft, and second and third sealing bodies for sealing a lower clearance formed between a lower part of the pump casing and the drive shaft, a fourth sealing body is disposed between the second and third sealing bodies in an axial direction of the drive shaft, the fourth sealing body sealing the lower clearance, further comprising a lubricant reservoir and a fluid communication passage between a space in the lower clearance sandwiched between the second and third sealing bodies and the lubricant reservoir.

3. The lubricant pump seal of claim 2, wherein the pump casing comprises a casing body enclosing the pump chamber and supporting the first and second sealing bodies, and a separate casing member secured to a lower surface of the casing body and supporting the third and fourth sealing bodies, an upper surface of the casing member including a groove, wherein at least a portion of the passage comprises the groove.

4. The lubricant pump seal of claim 2, wherein the pump casing comprises a casing body enclosing the pump chamber and supporting the first and second sealing bodies, and a separate casing member secured to a lower surface of the casing body and supporting the third and fourth sealing bodies, a lower surface of the casing body including a groove, wherein at least a portion of the passage comprises the groove.

5. The lubricant pump seal of claim 2, wherein the lubricant reservoir comprises a crank chamber of the engine.

6. The lubricant pump seal of claim 2, wherein the lubricant reservoir is located below a crank chamber of the engine.

7. A lubricant pump seal for an outboard motor, the outboard motor comprising an internal combustion engine, a water propulsion device, a drive shaft configured to transmit torque from the engine to the water propulsion device, a lubricant pump configured to supply lubricant to the internal combustion engine, the lubricant pump including a pump casing enclosing a pump chamber, the drive shaft extending through the pump casing, a rotor housed in the pump chamber for rotation with the drive shaft, a first sealing body for sealing an upper clearance formed between an upper part of the pump casing and the drive shaft, and second and third sealing bodies for sealing a lower clearance formed between a lower part of the pump casing and the drive shaft, a fourth sealing body is disposed between the second and third sealing bodies in an axial direction of the drive shaft, the fourth sealing body sealing the lower clearance, further comprising a cowling enclosing the engine and a fluid communication passage between a space in the lower clearance sandwiched between the second and third sealing bodies and an inside space of the cowling.

8. The lubricant pump seal of claim 7, wherein the pump casing comprises a casing body enclosing the pump chamber and supporting the first and second sealing bodies, and a separate casing member secured to a lower surface of the casing body and supporting the third and fourth sealing bodies, an upper surface of the casing member including a groove, wherein at least a portion of the passage comprises the groove.

9. The lubricant pump seal of claim 7, wherein the pump casing comprises a casing body enclosing the pump chamber and supporting the first and second sealing bodies, and a separate casing member secured to a lower surface of the casing body and supporting the third and fourth sealing bodies, a lower surface of the casing body including a groove, wherein at least a portion of the passage comprises the groove.

10. An outboard motor comprising an internal combustion engine, a propulsion unit driven by the engine, a housing enclosing the engine and at least a portion of the propulsion unit, a drive shaft extending between the engine and the propulsion unit, a lubricant pump unit configured to deliver lubricant to the engine, the lubricant pump unit including a pump casing and a pump chamber defined within the casing, the drive shaft extending through the lubricant pump unit, a seal disposed between the lubricant pump unit and the drive shaft, and means for using a fluid other than lubricant for relieving a negative pressure generated within the pump casing in the vicinity of the seal but outside of the pump chamber.

11. An outboard motor comprising an internal combustion engine, a propulsion unit driven by the engine, a housing enclosing the engine and at least a portion of the propulsion unit, a drive shaft extending between the engine and the propulsion unit, a lubricant pump unit comprising a pump chamber and being configured to deliver lubricant to the engine, the drive shaft extending through the lubricant pump unit, a clearance defined between the drive shaft and the lubricant pump unit, at least one seal in contact with the drive shaft and configured to seal the interior of the lubricant pump unit from an exterior of the pump unit, the seal being disposed between a portion of the clearance and the pump chamber, and a passage extending from the portion of the clearance to the exterior of the lubricant pump unit to allow air to bypass all of the seals in contact with the drive shaft and to flow into the portion of the clearance.

12. The outboard motor according to claim 11 additionally comprising a lubricant reservoir, wherein the passage extends to at least one of the lubricant reservoir, an internal cavity of the engine, and an enclosed space defined at least partially by the housing.

13. The outboard motor according to claim 12, wherein the passage extends to the lubricant reservoir and the space defined at least partially by the housing.

14. The outboard motor according to claim 13 additionally comprising a plug disposed in the passage blocking communication to the space defined at least partially by the housing.

15. An outboard motor comprising an internal combustion engine, a propulsion unit driven by the engine, a housing enclosing the engine and at least a portion of the propulsion unit, a drive shaft extending between the engine and the propulsion unit, a lubricant pump unit configured to deliver lubricant to the engine, the drive shaft extending through the lubricant pump unit, a clearance defined between the drive shaft and the lubricant pump unit, at least one seal in contact with the drive shaft and configured to seal the interior of the lubricant pump unit from an exterior of the pump unit, and a passage extending from the clearance to exterior of the lubricant pump unit, wherein the passage extends to a source of dry air within the housing.

16. A method of preventing moisture penetration into an interior of a lubricant pump of an outboard motor, the lubricant pump comprising a pump casing and a pump chamber, the method comprising providing a fluid communication passage between the pump chamber and a lubricant reservoir, generating negative pressure within the interior of the pump casing outside of the pump chamber, channeling fluid from a location above the level of liquid lubricant in the lubricant reservoir to the pump casing thereby eliminating the negative pressure.

17. A method of preventing moisture penetration into an interior of a lubricant pump of an outboard motor, the lubricant pump comprising a pump casing and a pump chamber, the method comprising: providing a fluid communication passage between the interior of the lubricant casing at a point outside the pump chamber and a space inside a cowling, generating negative pressure at the point within the pump casing, channeling fluid from the space inside the cowling, but not inside the a lubricant reservoir, to the point within the pump casing, thereby eliminating the negative pressure.

* * * * *

UNITED STATES PATENT AND TRADEMARK OFFICE

CERTIFICATE OF CORRECTION

PATENT NO. : 6,796,860 B1
APPLICATION NO. : 10/227506
DATED : September 28, 2004
INVENTOR(S) : Masanori Takahashi It is certified that error appears in the above-identified patent and that said Letters Patent is hereby corrected as shown below:

At column 4, line 6, after "Additionally," please delete "The" and insert -- the --, therefor.

At column 4, line 44, after "34", please delete "an" and insert -- and --, therefor.

At column 5, line 10, after "bearings" please insert -- , --.

At column 6, line 40, please delete "Attentively," and insert -- Alternatively, --, therefor.

At column 7, line 15, after "mounted" please delete "at the".

At column 7, line 66, after "Preferably" please insert -- , --.

At column 7, line 67, please delete "bole" and insert -- hole --, therefor.

At column 10, line 53, in Claim 16, after "casing" please insert -- , --.

At column 10, line 63, in Claim 17, after "inside the" please delete "a".

Signed and Sealed this

Sixth Day of May, 2008

JON W. DUDAS
*Director of the United States Patent and Trademark Office*